US008131197B2

(12) United States Patent
Hiraoka et al.

(10) Patent No.: US 8,131,197 B2
(45) Date of Patent: Mar. 6, 2012

(54) FIXING DEVICE AND ELECTRO PHOTOGRAPHIC APPARATUS USING THE SAME

(75) Inventors: Chikara Hiraoka, Osaka (JP); Kazuhiro Wakamatsu, Kanagawa (JP); Katsumi Kumada, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 957 days.

(21) Appl. No.: 12/153,813

(22) Filed: May 23, 2008

(65) Prior Publication Data

US 2008/0292374 A1 Nov. 27, 2008

(30) Foreign Application Priority Data

May 25, 2007 (JP) ..... P2007-138659

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 7,142,803 | B2 | 11/2006 | Koyama et al. | |
| 7,167,670 | B2 | 1/2007 | Obata et al. | |
| 7,231,158 | B2 | 6/2007 | Hiraoka et al. | |
| 7,233,764 | B2 * | 6/2007 | Naito et al. | 399/329 |
| 7,283,780 | B2 * | 10/2007 | Uchida et al. | 399/329 |
| 7,298,981 | B2 | 11/2007 | Oohara et al. | |
| 2005/0185996 | A1 * | 8/2005 | Oishi et al. | 399/329 |
| 2006/0034646 | A1 | 2/2006 | Hiraoka et al. | |

FOREIGN PATENT DOCUMENTS

| | | |
|---|---|---|
| JP | 4-305675 | 10/1992 |
| JP | 10-203674 | 8/1998 |
| JP | 11-24460 | 1/1999 |
| JP | 2004-126317 | 4/2004 |
| JP | 2005-55469 | 3/2005 |
| JP | 2005-234294 | 9/2005 |
| JP | 2006-235330 | 9/2006 |
| JP | 2006-258962 | 9/2006 |

* cited by examiner

*Primary Examiner* — David Gray

*Assistant Examiner* — Gregory H Curran

(74) *Attorney, Agent, or Firm* — McGinn IP Law Group, PLLC

(57) ABSTRACT

According to an aspect of the present invention, there is provided a fixing device including: a heating roller that generates a heat and is formed to have a mold releasing property; a pressure belt that is brought into contact with the heating roller and is driven according to a rotation of the heating roller; an arm that presses the pressure belt toward the heating roller; and a belt regulating member that contacts an end face of the pressure belt to regulate a shift thereof and is configured to be swingable with respect to the arm.

20 Claims, 7 Drawing Sheets

FIG. 7

| CONDITION | BELT REGULATING MEMBER | | | DEPRESSION OF END PORTION OF BELT | LIFETIME OF BELT (DAMAGE OF END PORTION) |
|---|---|---|---|---|---|
| | PROTRUSION | SWING | TILT OF FLANGE | | |
| 1 | WITHOUT PROTRUSION | NOT SWINGABLE | WITHOUT TILT | DEPRESSION IS GENERATED | DAMAGED AFTER 150 HOURS (BREAKAGE IN DEPRESSED PORTION) |
| 2 | WITHOUT PROTRUSION | NOT SWINGABLE | WITH TILT (FORCED TILT) | NO DEPRESSION IS GENERATED | DAMAGED AFTER 180 HOURS (CRACK IN END PORTION) |
| 3 | WITH PROTRUSION | SWINGABLE | WITH TILT | NO DEPRESSION IS GENERATED | NOT DAMAGED AFTER 250 HOURS |

FIXING DEVICE AND ELECTRO PHOTOGRAPHIC APPARATUS USING THE SAME

CROSS-REFERENCE TO RELATED APPLICATIONS

The entire disclosure of Japanese Patent Application No. 2007-138659 filed on May 25, 2007 including specification, claims, drawings and abstract is incorporated herein by reference in its entirety.

BACKGROUND OF THE INVENTION

1. Field of the Invention

An aspect of the present invention relates to an electro photographic apparatus such as a copier or a printer that uses electro photographic technology, and more particularly, to a fixing device capable of preventing damage of an end portion thereof and an electro photographic apparatus using the same.

2. Description of the Related Art

As a fixing device of an electro photographic apparatus, a belt fixing device in which an endless belt is provided to heat and melt a toner image is used (for example, see JP-2005-055469-A), and accordingly, a warming-up time can be shortened and a power consumption can be lowered. When a fixing process is performed by using the endless belt, there is a problem that the endless belt moves in a direction perpendicular to the rotation direction thereof, that is, a shift of the endless belt occurs, as the endless belt rotates.

To prevent the shift of the endless belt, a configuration in which a flange is provided to be brought into contact with the end face of the endless belt is used (for example, see JP-H04-305675-A). In addition, to prevent the shift of the endless belt, a configuration in which a steering roller is provided as a roller, over which the endless belt is suspended (for example, see JP-H10-203674-A and JP-H11-024460-A), is used. In the above-described method, when the endless belt is shifted, the steering roller is tilted by a motor so that an axis thereof is shifted to move and correct the endless belt in the opposite direction of the shifted direction.

However, the above-described general methods have a problem in durability of the belt and costs of parts. First, as in JP-H04-305675-A, when the configuration including the flange brought into contact with the end face of the belt is adapted, the end face of the belt is continuously slid on the flange. Accordingly, the end face of the endless belt is worn away, and thereby the durability is lowered. In addition, when the shifting force of the belt is strong, a depression or a wrinkle is generated in the end face of the belt, and there is a problem that an abnormal noise and damage are generated. Generally, in order to reduce the shifting force of the belt, it is needed to control a difference between left and right peripheral lengths of the belt, a thickness of the belt, and the degree of parallelism of the belt and each roller with high precision. Accordingly, the costs of the parts increase, and it is difficult to reduce the cost of the device.

On the other hand, as in JP-H10-203674-A and JP-H11-024460-A, when the configuration including the steering roller is adapted, a sensor that detects the position of the end face of the belt, a motor that tilts the shaft of the roller, a controller that controls the motor based on information detected by the sensor, and the like are needed. Accordingly, the number of parts increases, thereby increasing the size and the cost of the device. In addition, when the shaft of the steering roller is tilted, a wrinkle or a wave shape is generated in the belt due to a difference between tensile forces of the belt on the left and right sides, and accordingly, the durability of the belt is deteriorated.

SUMMARY OF THE INVENTION

According to an aspect of the present invention, there is provided a fixing device including: a heating roller that generates a heat and is formed to have a mold releasing property; a pressure belt that is brought into contact with the heating roller and is driven according to a rotation of the heating roller; an arm that presses the pressure belt toward the heating roller; and a belt regulating member that contacts an end face of the pressure belt to regulate a shift thereof and is configured to be swingable with respect to the arm.

According to another aspect of the present invention, there is provided an electro-photographic apparatus including the fixing device of above.

According to still another aspect of the present invention, there is provided a fixing device including: a heating roller including: a core metal; a heat source that generates a heat and is disposed in the core metal; a rubber layer that surrounds the core metal; and a coating that has a mold releasing property and coats the rubber layer; and a pressure unit including: a pressure belt that is brought into contact with the heating roller to form a nip therebetween and is driven according to a rotation of the heating roller; a pressure roller around which the pressure belt is surrounded; an arm that is disposed at an end of the pressure roller and presses the pressure roller to press the pressure belt toward the heating roller; and a belt regulating member that is disposed between the pressure belt and the arm, contacts an end face of the pressure belt to regulate a shift thereof and is configured to be swingable with respect to the arm.

BRIEF DESCRIPTION OF THE DRAWINGS

Embodiments of the present invention will be described in detail based on the following figures, wherein:

FIG. 7 is a diagram showing the result of evaluation of transportability of the pressure belt according to the embodiment;

DETAILED DESCRIPTION OF THE INVENTION

Hereinafter, a fixing device and an electro photographic apparatus according to embodiments of the present invention will be described with reference to the accompanying drawings.

Figure 3:
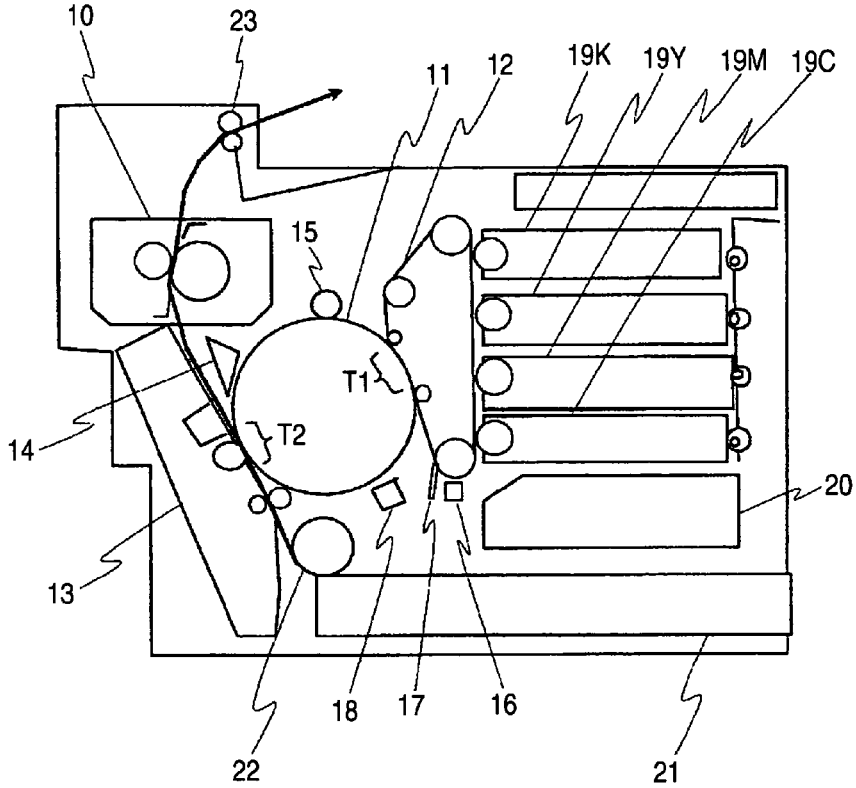
FIG. 3 is a schematic diagram showing the configuration of an electro photographic apparatus according to the embodiment.

First, an overview of the electro photographic apparatus according to an embodiment of the present invention will be described with reference to FIG. 3 that shows a schematic cross-section thereof. In FIG. 3, an intermediate transfer unit 11 is disposed in the center portion of the apparatus. In addition, in the vicinity of the intermediate transfer unit 11, a photosensitive unit 12, a transfer device 13, a paper peeling unit 14, an intermediate transfer unit cleaning unit 15 are disposed. In addition, in the vicinity of the photosensitive unit 12, an electric charger 16, a photosensitive member cleaning unit 17, a remaining-image removing unit 18 are disposed. In addition, developing devices 19K, 19Y, 19M, and 19C enclosing toner as fine colored powders of four different colors are disposed in a stacked form. On the lower side of the developing devices, an exposure unit 20 is disposed. In addition, on the much lower side of the developing devices, a paper holder 21 that holds paper sheets and a paper feeding device 22 are disposed. In the upper portion of the electro photographic apparatus, a fixing device 10 and a paper discharging device 23 are disposed.

In the above-described configuration, the electric charger 16 uniformly charges the surface of the photosensitive unit 12. Next, based on the information of an image and a character from a personal computer, an image scanner, or the like, light is exposed by the exposure unit 20 in units of dots, thereby forming an electrostatic latent image on the surface of the photosensitive unit 12.

Thereafter, as toner is supplied from any one of the developing devices 19K, 19Y, 19M, and 19C and is developed, the electrostatic latent image becomes visible as a toner image and is transferred to a first transfer position T1. At the first transfer position T1, the toner image is transferred on the surface of the intermediate transfer unit 11 due to a difference of electric potentials of the photosensitive unit 12 and the intermediate transfer unit 11 on which a power is supplied from a power source not shown in the figure. After the toner image passes the first transfer position T1, the electric potential of the surface of the photosensitive unit 12 is dropped to a level equal to or smaller than a specific value through a light emission performed by the remaining image removing unit 18, and the electrostatic latent image is removed. The remaining toner that has not been transferred at the first transfer position T1 and remains on the surface is cleaned by the photosensitive member cleaning unit 17, thereby enabling the next toner image formation. By repeating the above-described process by using the developing devices 19K to 19C a required number of times, a toner image corresponding to the information on the image and the character is formed on the surface of the intermediate transfer unit 11.

Thereafter, the toner image is transferred to a paper sheet, which has been supplied from the paper holder 21 by the paper feeding device 22, at a second transfer position T2 by the transfer device 13. The paper sheet on which the toner image has been transferred is peeled off from the intermediate transfer unit 11 by the paper peeling unit 14. Then, the paper sheet is moved to the fixing device 10, the toner image is fixed to the paper sheet, and the paper sheet is discharged from the paper discharging device 23.

Figure 2:
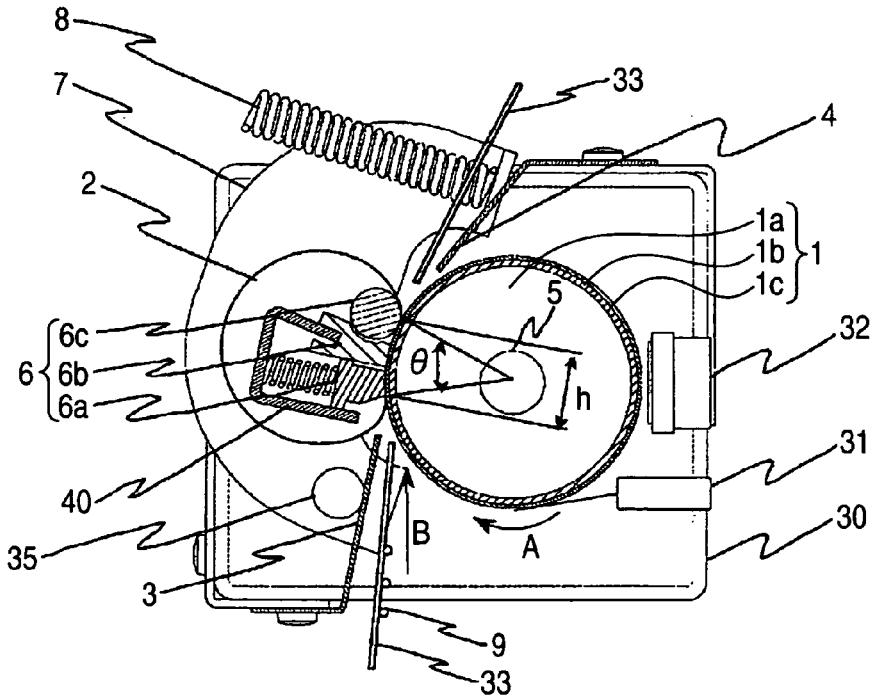
FIG. 2 is a cross-sectional view showing the configuration of the fixing device according to the embodiment.

Next, the fixing device 10 of the electro photographic apparatus according to an embodiment of the invention will be described with reference to FIG. 2 that shows a schematic cross-section thereof. The fixing device 10 is constituted by a heating roller 1, a pressure belt 2, an introducing guide 3, a peeling guide 4, and a side plate 30. In the embodiment, the heating roller 1 is an elastic roller that has an outer diameter of 40.4 mm and is coated by a silicon rubber layer 1*b* having a thickness of 0.8 mm and JIS hardness of 20 degrees on an aluminum metal core 1*a* having a thickness of 1 mm and a pipe shape. On the surface of the heating roller, a coating film 1*c* of PFA (tetrafluoroethylene perfluoro (alkyl vinyl ether) copolymer) having a thickness of 30 μm is coated for ensuring a mold releasing property for toner. Inside the heating roller, a heater 5 is provided. By using heat of the heater 5, the toner is melt. The heating roller 1 is supported by the side plate 30 to be rotatable in a direction of arrow A by a gear not shown in the figure.

In the present invention, the pressure belt 2 is a seamless polyimide belt having a thickness of 80 μm and an inner diameter of 30 mm. On the surface of the pressure belt 2, PFA having a thickness of 30 μm is coated for ensuring a mold releasing property for toner. The pressure belt 2 is mounted by pressure unit 6 including pressure members 6*a* and 6*b* and a pressure roller 6*c*. The pressure belt 2 is brought into contact with the heating roller 1 at a winding angle θ by a pressure stays 40, a pressure arm 7, and a pressure spring 8 with respect to a shaft 35 disposed on the side plate 30 used as a base position. Accordingly, the pressure belt 2 forms a contact portion h with the heating roller 1 to melt the toner 9. Since a contact width h that contributes to a fixing speed can be adequately provided even in a case where the heating roller 1 has a small diameter, miniaturization of the fixing device can be achieved, and a fixing process at high speed can be performed. In this embodiment, the fixing speed of 200 mm/s is achieved with the contact width h=11 mm and θ=47°.

In the vicinity of the heating roller 1, a thermistor 31 that detects surface temperature of the heating roller 1 for controlling a heat emission of the heater 5 and a thermostat 32 used for detecting abnormal temperature of the heating roller 1 are provided.

Accordingly, the paper sheet 33 onto which unfixed toner 9 have been transferred is conveyed in the direction of arrow B, and is brought into contact with the heating roller 1 in the contact portion h. After the toner 9 is melted to be fixed to the paper sheet in the contact portion, the paper sheet is peeled off from the heating roller 1 to be discharged by the peeling guide 4.

Next, a shift preventing mechanism of a pressure belt according to an embodiment of the present invention will be described with reference to FIGS. 1 and 4.

Figure 1:
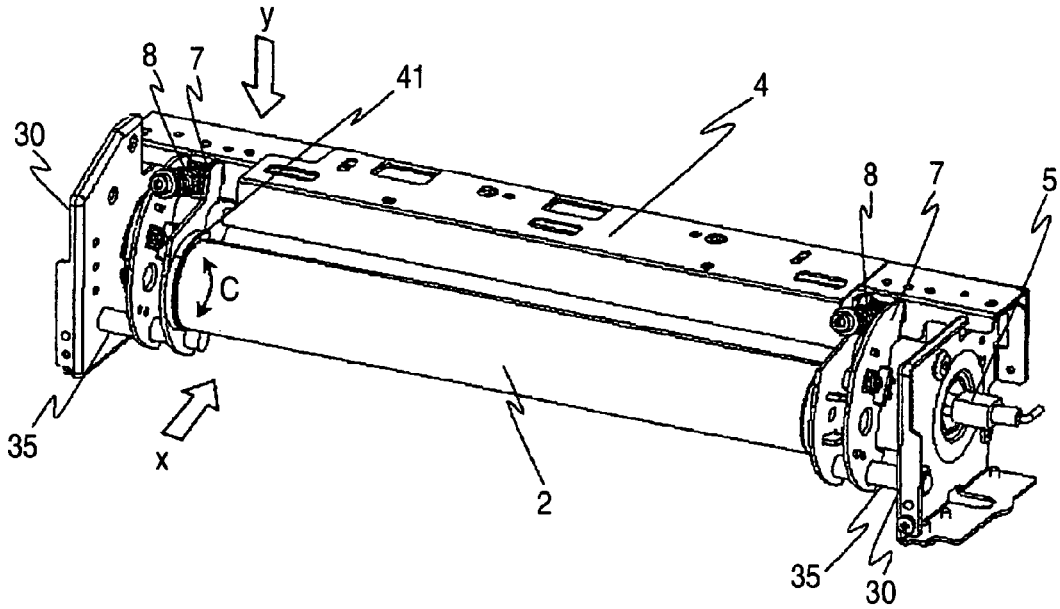
FIG. 1 is a perspective view showing the external appearance of a fixing device according to an embodiment.

FIG. 1 is a perspective view showing the outer appearance of the fixing device. The shift of the pressure belt 2 is prevented by bring the end face thereof into contact with the belt regulating member 41. The shape of the belt regulating member 41 will be described later in detail. The belt regulating member 41 has at least one protrusion on the surface brought into contact with the pressure arm 7. Accordingly, the belt regulating member 41 is brought into contact with the end face of the belt at a specific angle, and has a structure for swinging in the direction of arrow C shown in the figure from the protrusion as a base position.

Figure 4:
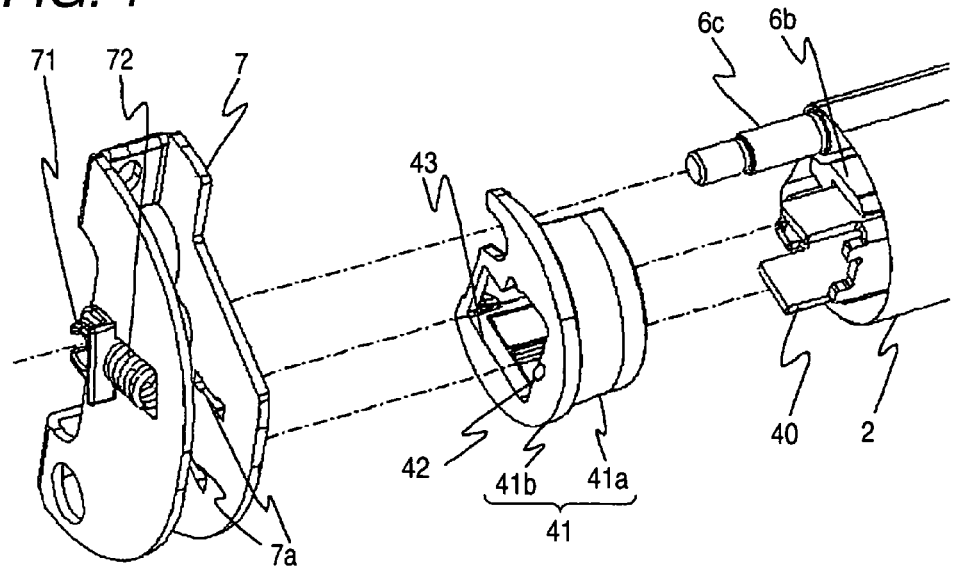
FIG. 4 is an exploded diagram showing a pressure structure of the fixing device according to the embodiment.

FIG. 4 shows an exploded view of the pressure structure of a pressure belt shift preventing mechanism and a perspective view showing the outer appearance of the belt regulating member 41.

The belt regulating member 41 includes a guide part 41*a* in the shape of an approximate cylinder which is brought into contact with the inner side of the pressure belt 2 and guides the pressure belt 2 and a flange part 41*b* that is brought into contact with the end side of the pressure belt 2 and prevents the shift of the pressure belt 2. The flange part 41*b* has a hole 43 that is engaged with the pressure stays 40 with a specific gap interposed therebetween. On the surface of the flange part 41*b* that is brought into contact with the pressure arm 7, a protrusion 42 is provided. The height and shape of the protrusion 42 will be described later.

Since the belt regulating member 41 is rubbed with the pressure belt 2 all the time, it is formed of a resin having an excellent heat resistance and slidability. In this embodiment, the belt regulating member is formed of PPS (poly (phenylene sulfide)) that is produced by TORAY INDUSTRIES, Inc. and the type of A504×90. In the pressure arm 7, a groove 7*a* that is engaged with the pressure stays 40, a bearing 71 that maintains the rotation of the pressure roller 6*c*, and a spring 72 that brings the pressure roller 6*c* into contact with the heating roller with a specific load are provided.

Next, a mechanism for preventing the depression or damage of the end portion of the pressure belt 2 according to the embodiment will be described with reference to FIGS. 5 to 7.

Figure 5:
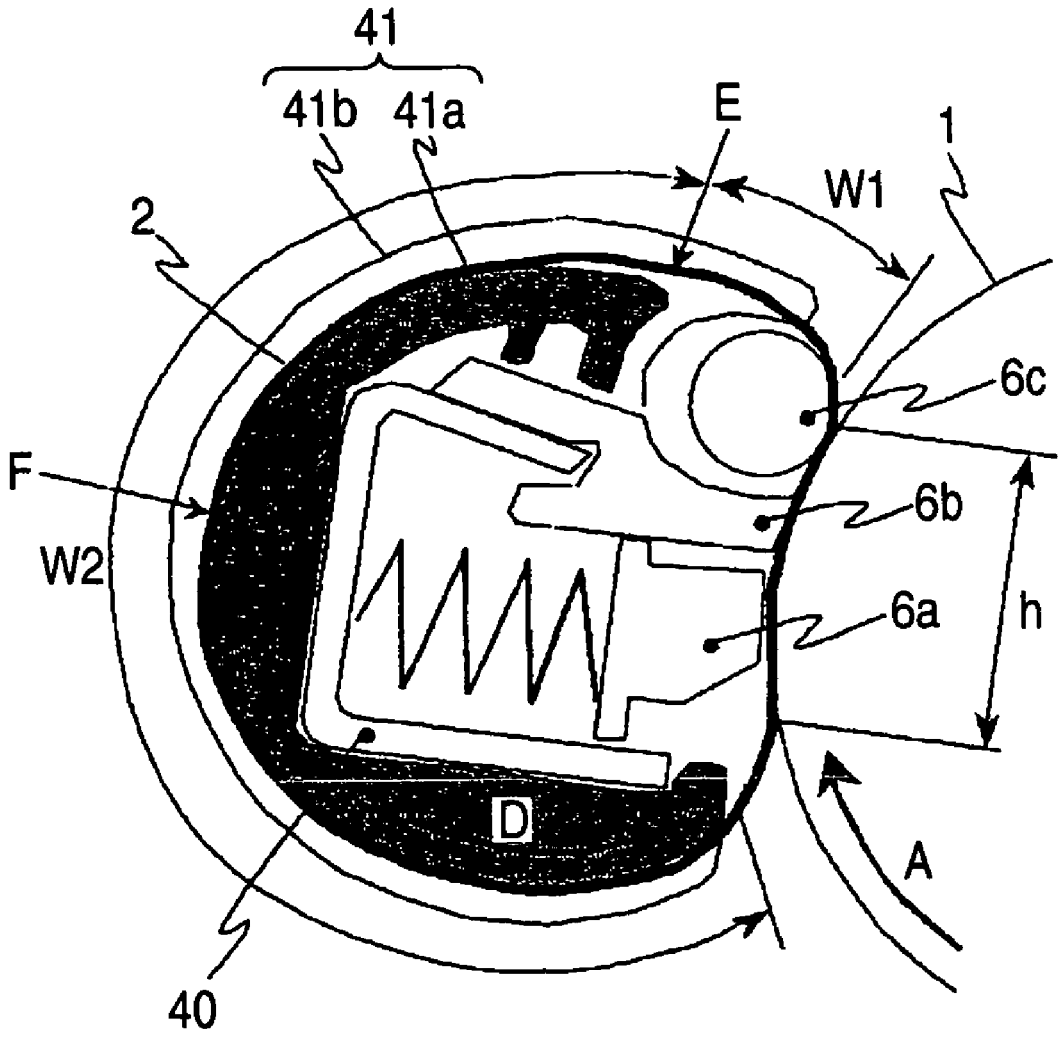
FIG. 5 is an enlarged cross-sectional view of the transport structure of a pressure belt according to the embodiment.

FIG. 5 is an enlarged cross-sectional view of the transport structure of the pressure belt 2. Since the pressure belt 2 is rotated in the direction of arrow D shown in the figure by a rotational driving force of the heating roller 1, the pressure belt 2 is loosened in the range W1 on the ejecting side of a nip portion h. Accordingly, as the pressure belt approaches the introducing side of the nip portion h, a tensile force is applied. In addition, in the range W2, the pressure belt 2 forms a track following the guide part 41*a* of the belt regulating member 21. Accordingly, at point E near the ejecting side of the nip portion h, when the end face of the pressure belt 2 is brought into contact with the flange part 41*b* of the belt regulating member 41, the pressure belt 2 is not guided by the guide part 41*a* and is in a freely movable state, thereby causing a buckling and a depression. As a result, as the pressure belt 2 is rotated, an abnormal noise is generated or a crack or a fracture is generated in the pressure belt 2 from the depression.

As shown in FIG. 5, W1 is a part from the end of the nip portion h to a point where the guide part 41*a* is provided and extends around 10 mm from the end of the nip portion h. W2 is a part that is substantially along the guide part 41*a* and is a substantially opposite side of the nip portion h.

According to the embodiment, as described above, by disposing the protrusion 42 on the surface of the flange part 41*b* so as to be brought into contact with the pressure arm 7, the flange part 41*b* is tilted with respect to the end face of the pressure belt 2. In addition, a point F where the end face of the pressure belt 2 and the flange part 41*b* are brought into contact with each other is disposed in the range W2 in which the pressure belt 2 is bent and guided along the guide part 41*a*. Accordingly, owing to the effect of bending of the pressure belt 2 and the effect of regulation of the guide part 41*a*, the strength (buckling strength) of the end face of the pressure belt 2 in the longitudinal direction increases, and thereby the buckling or depression of the end face of the pressure belt 2 can be prevented.

Next, another advantage according to an embodiment of the present invention, that is, an increase in durability of the pressure belt 2 will be described with reference to FIGS. 6A and 6B.

Figure 6A:
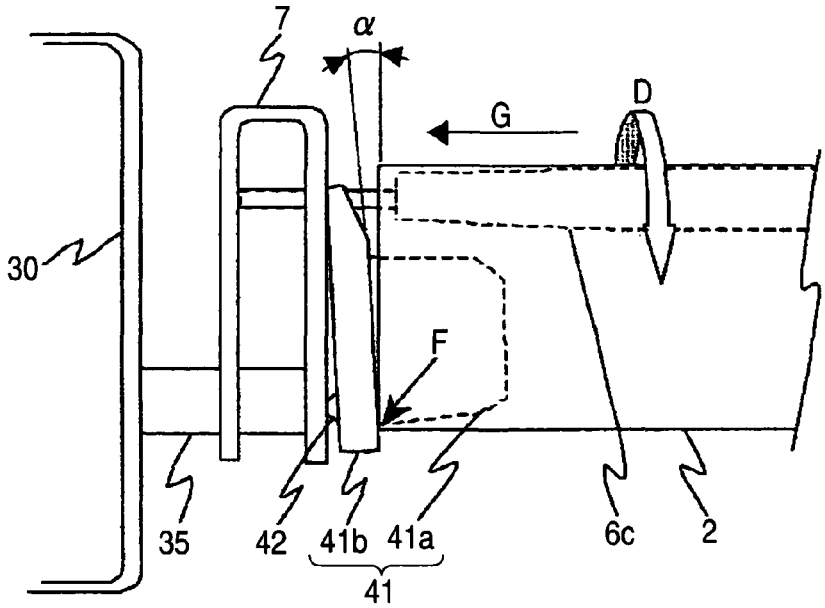
FIG. 6A is a top view showing the vicinity of an end portion of the pressure belt according to the embodiment.
Figure 6B:
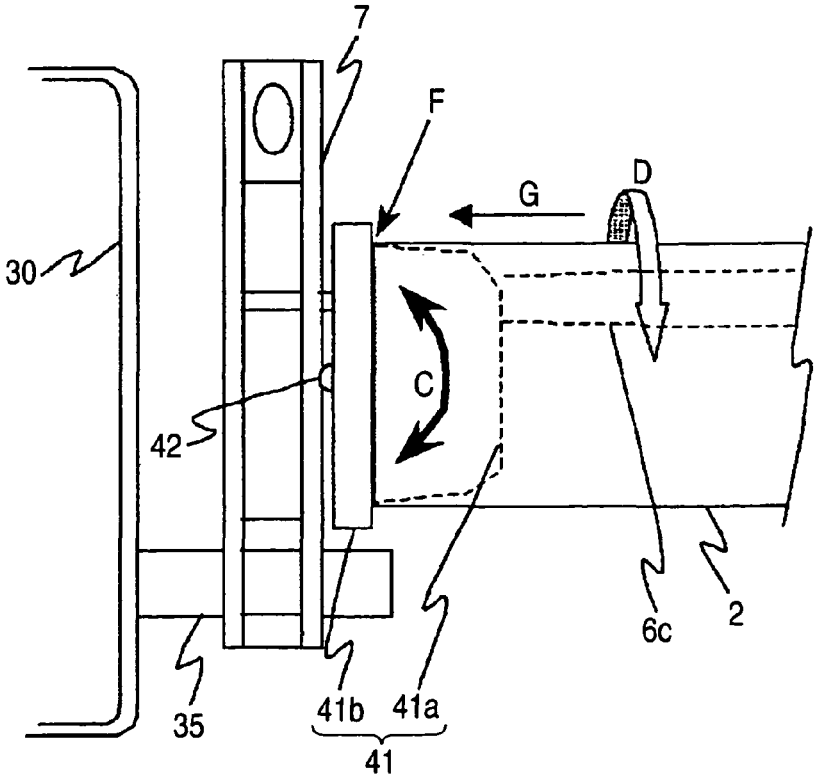
FIG. 6B is a front view showing the vicinity of the end portion of the pressure belt according to the embodiment.

FIGS. 6A and 6B are schematic diagrams showing the configurations in the vicinity of the end face of the pressure belt, viewed from directions y and x shown in FIG. 1 described above. Arrow D shown in the figure represents the rotation direction of the pressure belt 2, and arrow G represents the direction of shift of the pressure belt 2. As shown in FIG. 6A, by disposing the protrusion 42 between the flange part 41*b* of the belt regulating member 41 and the pressure arm 7, the flange part 41*b* is brought into contact with the end face of the pressure belt 2 at the point F so that an angle α is formed therebetween. As shown in FIG. 6B viewed from the direction x shown in FIG. 1, the flange part 41*b* is configured to be able to swing in direction C with respect to the protrusion 42 as a base position.

Accordingly, after the end face of the pressure belt 2 passes the point F, the flange part 41*b* is brought into contact with the end face of the pressure belt 2 in accordance with the shape of end face of the pressure belt 2. That is, the contact between the pressure belt 2 and the flange part 41*b* is not a point contact but a facial contact. In other words, since the shifting force of the pressure belt 2 in the direction of arrow G is received by the flange part 41*b* along the face thereof, the shifting force is dispersed. As a result, abrasion of the end face of the pressure belt 2 and the flange part 41*b* decreases, thereby increasing the durability of the pressure belt 2.

As the contact angle α between the end face of the pressure belt 2 and the flange part 41*b* increases, the abrasion therebetween and the swingable range of the flange part 41*b* increase, thereby causing a wave shape or distortion over the whole pressure belt 2. Therefore, the contact angle α between the end face of the pressure belt 2 and the flange part 41*b* is adjusted within a suitable range, preferably in the range of 1° to 2°. In this embodiment, the contact angle is set to 1.2°, and the height of the protrusion 42 is set to 0.5 mm.

In this embodiment, the protrusion 42 is disposed on the belt regulating member 41 in consideration of easiness of formation of the resin. However, the protrusion 42 may be formed on the pressure arm 7 through the half-piercing. In addition, although only one protrusion 42 is provided in the above-described embodiment, a plurality of protrusions 42 may be provided. In such a case, one of the plurality of protrusions 42 that functions as the base position for swing may be set higher than those of the others for acquiring the same advantage as described above. According to an aspect of the present invention, by configuring the belt regulating member 41 to be swingable with respect to the pressure arm 7, and more particularly by providing the protrusion 42 in a contact face of the belt regulating member 41 and the pressure arm 7, a stable rotation of the pressure belt 2 and an increase in the durability of the pressure belt 2 can be achieved without increasing the number of parts.

Next, a verified result of the advantage of the present invention will be described with reference to FIGS. 7 to 9. FIG. 7 is a verified result of the depression of the end portion of the pressure belt and a lifetime of the pressure belt 2 before damage for the following three conditions.

Condition 1: The belt regulating member 41 does not have a protrusion and is not swingable (FIG. 8).

Condition 2: The belt regulating member 41 does not have a protrusion and is not swingable, and the flange is configured to be tilted with respect to the end face of the pressure belt (FIG. 9).

Condition 3: The belt regulating member 41 has a protrusion 42 disposed thereon and is swingable (this condition corresponds to the embodiment as shown in FIGS. 6A and 6B).

The evaluation of the depression of the end portion of the pressure belt and the lifetime of the pressure belt before damage was performed under the conditions as follows:

shifting force of the pressure belt 2 (load applied to the belt regulating member from the pressure belt): 14.7 [N];

temperature of the heating roller 1: 170° C.; and rotation state of the pressure belt 2: one minute of an idle rotation state without feeding a paper sheet and one minute of a halt state (turning the heater off) are alternately switched.

Figure 8:
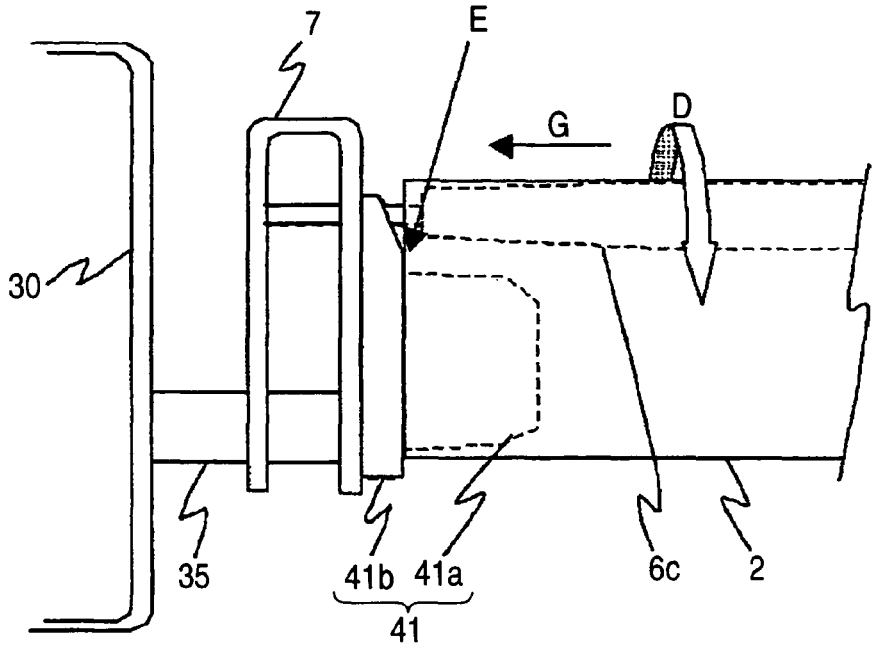
FIG. 8 is a top view showing the vicinity of an end portion of a pressure belt of a general example.
Figure 10:
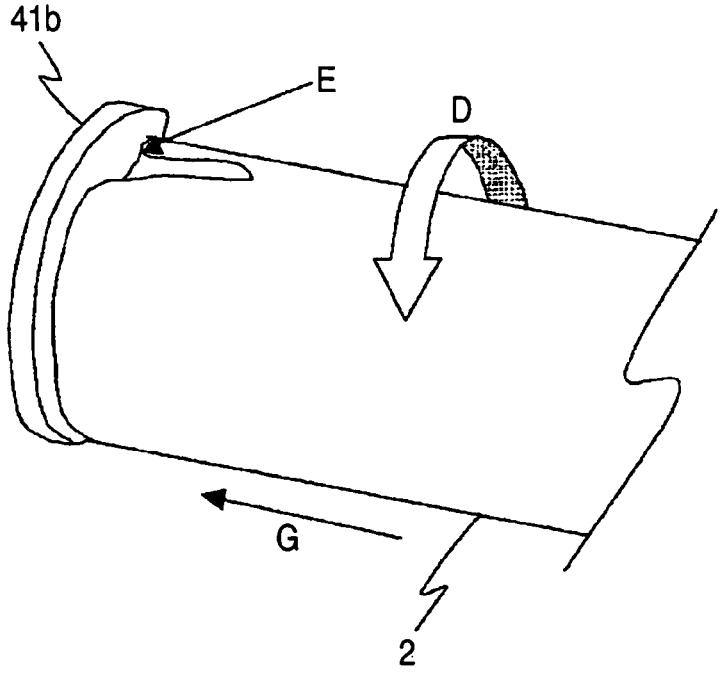
FIG. 10 is a diagram showing a depressed state of an end portion of a pressure belt.

Condition 1, as shown in FIG. 8, is a case where the flange part 41*b* of the belt regulating member 41 does not have any protrusion and the belt regulating member 41 does not swing. In addition, the contact position of the pressure belt 2 and the flange part 41*b* is configured as a point E at which the pressure belt 2 is not guided by the guide part 41*a* near the ejecting side of the nip. As a result, as shown in FIG. 10, depression due to buckling was generated in the end portion of the pressure belt 2 from the point E as a base position in accordance with the rotation of the pressure belt 2 in a rotation direction D, and an abnormal noise was generated from almost the beginning of the start. Then, the rotation and the halt of the pressure belt was repeated in the state, and breakage occurred in the position of the depression after about 150 hours of rotation from the start.

Figure 9:
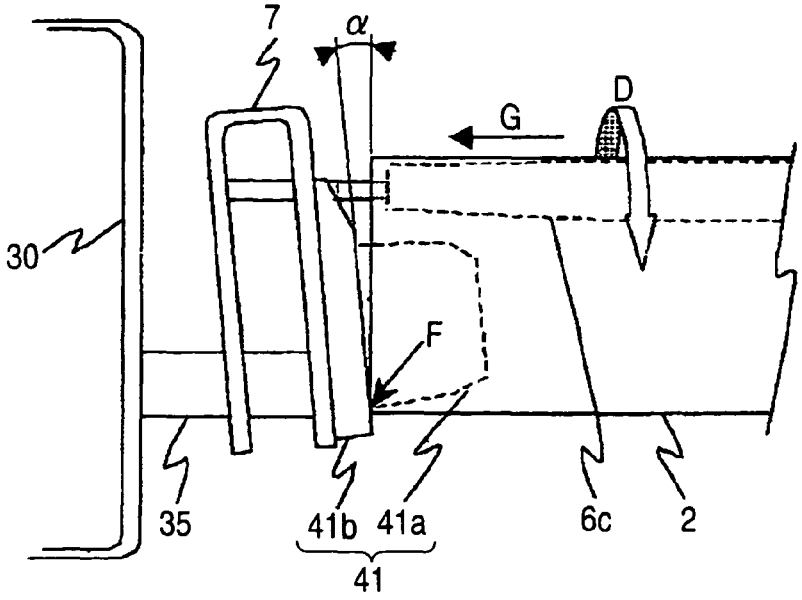
FIG. 9 is a top view showing the vicinity of an end portion of a pressure belt of another general example.

Condition 2, as shown in FIG. 9, is a case where the flange part 41*b* of the belt regulating member 41 does not have any protrusion and the belt regulating member 41 does not swing. However, by configuring the pressure arm 7 to be forcedly tilted with respect to the shaft 35 of the side plate 30, the flange part 41*b* is brought into contact with the end face of the pressure belt 2 at an angle α. Accordingly, the end face of the pressure belt 2 and the flange part 41*b* contact at the point F in the point contact state.

Figure 11:
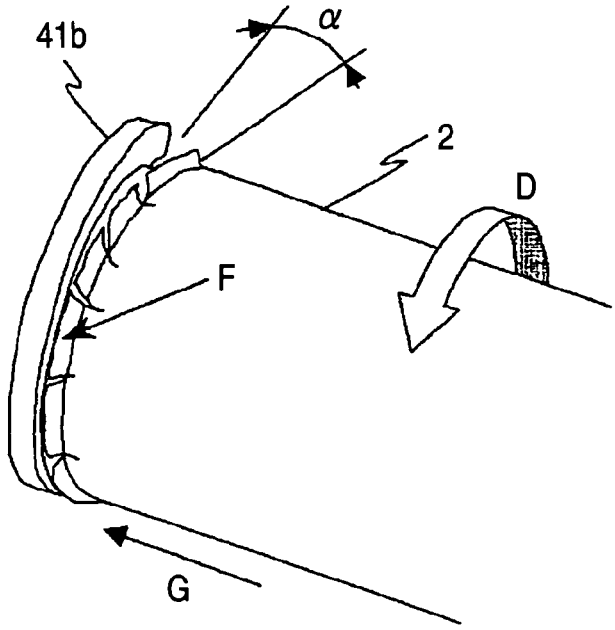
FIG. 11 is a diagram showing the state of damage of an end portion of a pressure belt.

The angle α is set to 1.2° as in this embodiment of the present invention. As a result, there was no depression of the end portion of the pressure belt, and the pressure belt 2 was stably rotated. However, after about 180 hours of rotation from the start, as shown in FIG. 11, the end face of the pressure belt 2 was broken in the shape of an open flower. The reason is that the belt regulating member 41 is fixed at the angle α and receives the shifting force of the pressure belt of 14.7 N all the time at the point F, and the pressure belt 2 is slowly buckled.

Condition 3 is a case where the above-described embodiment is adapted. As shown in FIGS. 6A and 6B, by providing a protrusion 42 having a height of 0.5 mm on the flange part 41*b* so that the belt regulating member 41 is tiled at an angle α (=1.2°) with respect to the end face of the pressure belt 2 and is swingable in accordance with the shape of the end face of the pressure belt with respect to the protrusion 42 as a base position. As a result, the pressure belt 2 was not depressed, and crack, damage, or the like of the pressure belt did not occur after 250 hours of rotation from the start.

As described above, according to an aspect of the present invention, the shift of the pressure belt 2 is prevented and the depression or damage of the end portion of the pressure belt 2 can be prevented, by using a small number of parts without increasing the costs of the parts or increasing the size of the fixing device, and thereby a fixing device having stable rotation of the pressure belt 2 and a long lifetime can be provided.

According to an aspect of the present invention, a fixing device having a long lifetime achieved by preventing the shift of the belt without increasing the costs of parts using a small number of the parts and preventing the depression or breakages of the end face of the belt and an electro photographic apparatus having the fixing device can be provided.

What is claimed is:

1. A fixing device, comprising:

a heating roller that generates heat and has a mold releasing property;

a pressure belt that is brought into contact with the heating roller to form a nip therebetween and is driven according to a rotation of the heating roller;

a pressure roller around which the pressure belt is surrounded;

an arm that holds an end of the pressure roller and presses the pressure roller to press the pressure belt toward the heating roller; and a belt regulating member that swingably intervenes between the pressure belt and the arm and contacts an end face of the pressure belt to regulate a shift thereof, wherein the arm comprises a first surface which faces toward the belt regulating member, and the belt regulating member comprises a second surface which faces toward the arm, and wherein a protrusion is formed on at least one of the first and second surfaces such that the belt regulating member is inclined with respect to the arm, to thereby push a contact point between the belt regulating member and the end face of the pressure belt away from the nip.

2. The fixing device according to claim 1, wherein the belt regulating member includes:

a guide part that is formed in a partial cylindrical shape and guides an inner side of the pressure belt; and a flange part that contacts the end face of the pressure belt.

3. The fixing device according to claim 2, wherein the belt regulating member is configured to be swingable around the protrusion with respect to the arm.

4. The fixing device according to claim 2, wherein the flange part is inclined with respect to the end face of the pressure belt, and wherein the end face of the pressure belt contacts the flange part at a point where the pressure belt is bent to contact the guide part.

5. The fixing device according to claim 2, wherein a range of an angle formed between the flange part and the end face of the pressure belt is equal to or smaller than 2 degrees.

6. The fixing device according to claim 1, wherein the belt regulating member comprises a resin having a heat resistance property and a is slidable.

7. An electro-photographic apparatus comprising the fixing device according to claim 1.

8. The fixing device according to claim 1, further comprising:

a pressure stay that brings into contact the pressure belt with the heating roller, wherein the arm comprises a groove that engages with the pressure stay.

9. The fixing device according to claim 8, wherein the arm further comprises:

a bearing that maintains the rotation of the pressure roller; and a spring that brings the pressure roller into contact with the heating roller.

10. The fixing device according to claim 1, wherein the arm comprises:

a bearing that maintains the rotation of the pressure roller; and a spring that brings the pressure roller into contact with the heating roller.

11. The fixing device according to claim 1, wherein the end of the pressure roller is inserted in the arm into a lateral direction of an extension of the pressure belt.

12. The fixing device according to claim 1, wherein the protrusion is disposed on the second surface of the belt regulating member to abut the arm.

13. The fixing device according to claim 12, wherein the protrusion causes the belt regulating member to be swingable with respect to the arm.

14. The fixing device according to claim 12, further comprising a plurality of ones of the protrusion.

15. A fixing device, comprising:

a heating roller, including:

a core metal;

a heat source that generates a heat and is disposed in the core metal;

a rubber layer that surrounds the core metal; and a coating that has a mold releasing property and coats the rubber layer; and a pressure unit, including:

a pressure belt that is brought into contact with the heating roller to form a nip therebetween and is driven according to a rotation of the heating roller;

a pressure roller around which the pressure belt is surrounded;

an arm that holds an end of the pressure roller and presses the pressure roller to press the pressure belt toward the heating roller; and a belt regulating member that is disposed between the pressure belt and the arm, and that contacts an end face of the pressure belt to regulate a shift thereof and is configured to be swingable with respect to the arm, wherein the arm comprises a first surface which faces toward the belt regulating member, and the belt regulating member comprises a second surface which faces toward the arm, and wherein a protrusion is formed on at least one of the first and second surfaces such that the belt regulating member is inclined with respect to the arm, to thereby push a contact point between the belt regulating member and the end face of the pressure belt away from the nip.

16. The fixing device according to claim 15, wherein the pressure roller engages with a bearing located in the arm.

17. The fixing device according to claim 15, wherein the arm comprises:

a bearing that maintains the rotation of the pressure roller; and a spring that brings the pressure roller into contact with the heating roller.

18. The fixing device according to claim 17, further comprising:

a pressure stay that brings into contact the pressure belt with the heating roller, wherein the arm further comprises a groove that engages with the pressure stay.

19. The fixing device according to claim 15, wherein the arm abuts the belt regulating member in a lateral direction of an extension of the pressure belt.

20. The fixing device according to claim 15, wherein the end of the pressure roller is inserted into the arm in a lateral direction of an extension of the pressure belt.

* * * * *